United States Patent [19]

Koizumi et al.

[11] 4,212,706

[45] Jul. 15, 1980

[54] METHOD OF CONTROLLING PRESSURE OF GAS CIRCULATING IN THE COKE DRY QUENCHING APPARATUS

[75] Inventors: Kunihei Koizumi, Yokohama; Tatu Otani, Yokosuka; Toshinobu Katata, Kanagawa; Takeshi Ueda, Yokohama, all of Japan

[73] Assignee: Nippon Kokan Kabushiki Kaisha, Tokyo, Japan

[21] Appl. No.: 815,458

[22] Filed: Jul. 13, 1977

[30] Foreign Application Priority Data

Jul. 13, 1977 [JP] Japan ..... 51-82479

[51] Int. Cl.[2] ..... C10B 39/02

[52] U.S. Cl. ..... 201/39; 202/228; 266/89; 266/156

[58] Field of Search ..... 201/39, 1; 432/47, 48; 202/228; 110/229-231, 204, 185, 186, 189; 266/89-156

[56] References Cited

U.S. PATENT DOCUMENTS

| | | | |
|---|---|---|---|
| 958,184 | 5/1910 | Schulte | 201/39 |
| 1,814,787 | 7/1931 | Daae | 48/87 |
| 3,767,536 | 10/1973 | Ikeda et al. | 202/263 |
| 3,795,987 | 3/1974 | Kemmetmueller | 34/168 |
| 3,799,521 | 3/1974 | Celada et al. | 266/156 X |
| 3,849,061 | 11/1974 | Summer | 432/47 |
| 3,857,758 | 12/1974 | Mole | 201/40 |
| 4,076,593 | 2/1978 | Koizumi et al. | 201/39 |
| 4,106,998 | 8/1978 | Okada et al. | 201/39 |

*Primary Examiner*—R.E. Serwin
*Assistant Examiner*—Roger F. Phillips
*Attorney, Agent, or Firm*—Armstrong, Nikaido, Marmelstein & Kubovcik

[57] ABSTRACT

In the dry quenching apparatus for red hot coke, the amount of quenching gas to a cooling chamber is controlled by controlling the speed of rotation of a blower in order to fix a diverging point between the positive pressure and the negative pressure at one point. The pressure around the diverging point is controlled so that the pressure is maintained at 0±5 mm in Aq.

2 Claims, 4 Drawing Figures

Relation between amount of circulating gas and rotation number of blower (180°c)

METHOD OF CONTROLLING PRESSURE OF GAS CIRCULATING IN THE COKE DRY QUENCHING APPARATUS

BACKGROUND OF THE INVENTION

This invention relates an improved method of dry quenching red hot coke in a dry quenching apparatus, and more particularly to a method of controlling the pressure of gas circulating within the quenching apparatus to prevent escape of the gas from a top charging port of a quenching station, combustion of coke by absorbing the air, or damages to the facilities caused by abnormal pressure, and to thereby carry out a safe and stable dry quenching operation.

Recently, there has been developed a dry quenching method for red hot coke from a coke oven, which is performed by an apparatus provided with a charging port at the top thereof for the red hot coke, and an exit port at its bottom. Closed gas-circulating ducts communicate with a quencher having a vertical cooling chamber therein, and a heat-exchanger, and a blower are provided whereby the quenching gas passes upwardly through the body of coke filled in the cooling chamber.

In this kind of the conventional operation, $N_2$ gas is supplied into the circuit to maintain the composition of the quenching gas constant, or air enters the system, resulting in changes in the amount or pressure of the flowing gas. In view of such circumstances, the prior art has built a countermeasure which arranges a damper and a bleeder to control the amount of the gas to the cooling chamber by the damper and to discharge surplus gas through the bleeder, the damper being arranged at a gas introducing portion positioned at the lower part of the cooling chamber and the bleeder being arranged at the exit of the fan.

However, this method of controlling the amount of gas flowing by controlling the damper cannot keep constant a diverging point between a positive pressure and a negative pressure in the circulating system (hereinafter briefly called a diverging point), that is, the zero point moves, upon closing the damper, from the gas leading portion at the top of the cooling chamber to a point in the direction of the heat exchanger, or it positions below the gas leading portion upon opening the damper. Consequently, when the damper is closed, the pressure at the upper portion of the cooling chamber becomes positive, and it becomes negative when opened, with the result that when the cover is opened for charging the coke, the gas bearing dust, CO and other elements is exhausted in large quantities and pollutes the environment, or conversely a large quantity of air is absorbed during the charging of the coke due to the negative pressure within the top portion of the quenching station and this causes a combustion loss in the coke. Further although discharging of the surplus gas may control overpressure caused by the air introduced through the duct between the quencher and the heat exchanger, the desired controlling cannot be provided for on the overpressure within the cooling chamber which is caused by $N_2$ gas introduced at the quenching gas introducing part, and for the changes of the pressure within the circulating system which are caused by the overpressure at the top of the cooling chamber created by gas generated from the red hot coke, and therefore the load is unnecessarily increased on the heat exchanger, fan, ducts or other facilities.

Thus, there still remains problems to be solved in the prior art.

SUMMARY OF THE INVENTION

The present invention has succeeded in removing the shortcomings involved in the prior art in order to easily and exactly control the pressure within the gas circulating system.

It is an object of the invention to control the amount of the quenching gas flowing into the cooling chamber by controlling the speed of rotation of the fan in order to provide a rate of flow of quenching gas which is responsive to the amount and temperature of red hot coke fed into the cooling chamger. It is also an object of the invention to automatically control the pressure around the diverging poing and at the lower part and the top of the quenching station in order to maintain the pressure around the flue at $0\pm5$ mmAq.

Thus, it is possible to prevent emission of the gas or absorption of the air when charging the red hot coke, and abnormal pressures, and it is possible to perform the safe operation without damaging the equipment.

DETAILED DESCRIPTION OF THE PREFERRED EMBODIMENT

Figure 1:
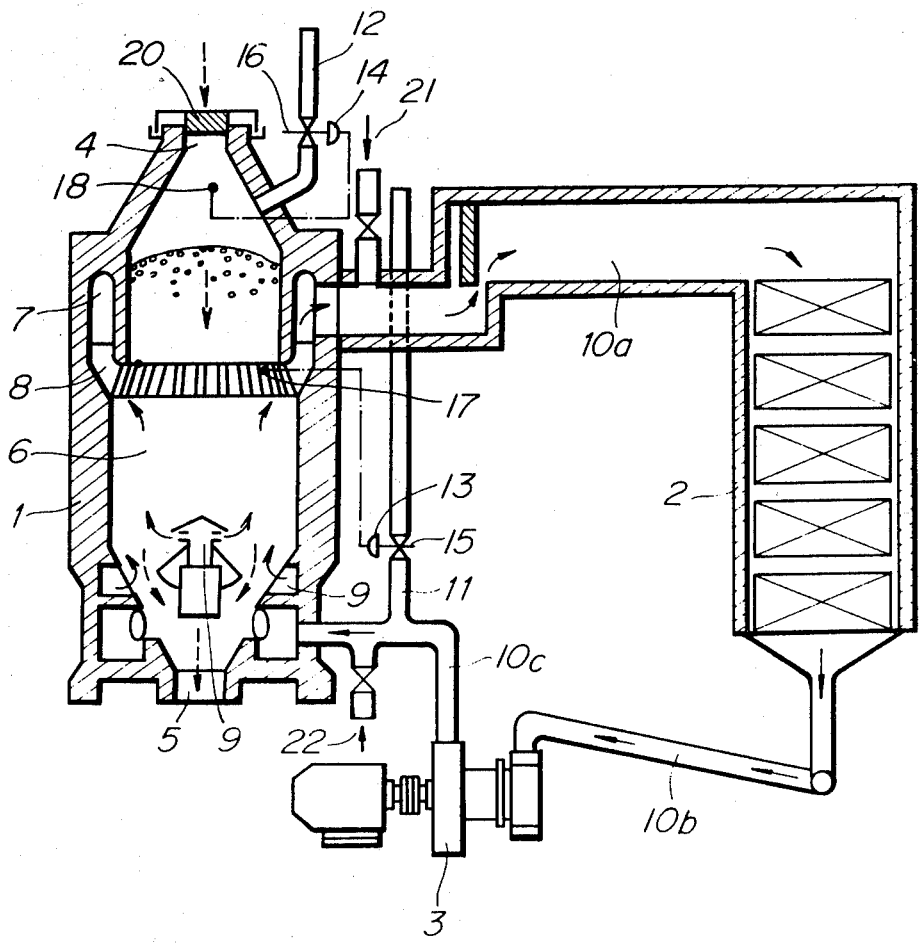
FIG. 1 shows an embodiment of a pressure controlling method for the gas circulating system in a coke dry quenching apparatus according to the invention.

Embodiments according to the invention will be discussed with reference to the accompanying drawings. In FIG. 1, a numeral (1) is a quenching station, (2) is a heat-exchanger, (3) is a blower or fan, and (4) is a charging port for the red hot coke positioned at the top of the quenching station, which is normally closed with the cover (20). A numeral (5) is an exhaust port at a bottom of the quenching station, (6) is a vertical cooling chamber between the charging port (4) and the exhaust port (5), (7) is a tubular gas leading portion provided in a circumferential wall of the upper part of the cooling chamber (6), (8) is a slant flue communicating the gas leading portion (7) and the cooling chamber (6), and (9) is another gas leading portion provided near the bottom of the cooling chamber. Ducts (10*a*) (10*b*) and (10) are positioned between the gas leading portion (7) and the heat exchanger (2), between the heat exchanger (2) and the fan (3), and between the fan (3) and the gas leading portion (9), thereby forming a closed circuit for the flow of the quenching gas.

In the quenching operation, the red hot coke is charged into the cooling chamber (6) from the charging port (4), and then the quenching gas within the circulating system is fed into the cooling chamber (6) through the gas leading portion (90 by means of the fan (3). Thus, the quenching gas passes upwardly through the body of coke to remove heat from the coke, and goes to the tubular gas leading portion (7) via the flue (8), from which the gas further runs through the duct (10*a*) to the heat exchanger (2) to be cooled there. This cooled gas is drawn through the fan (3) from the duct (10*b*), and is again supplied into the cooling chamber (6) through the gas leading portion (9). While repeating the above mentioned gas circulation, the quenched coke is discharged from the exhaust port (5), and the red hot coke is charged into the charging port (4).

In this connection, the quenching gas is initially the air, and during the operation, the gas composition is made generally 5% $CO_2$, 14% CO, 4% $H_2$, 75% $N_2$ and 1% $0_2$ for preventing the combustion loss of the red hot coke and explosions. In order to provide such composition, air is supplied via air inlet port (21) to duct (10*a*) between the gas leading portion (7) and the heat exchanger (2), and $N_2$ gas is fed via nigrogen inlet port (22) to duct (10*c*) between fan (3) and to gas leading portion (9) consequently the amount and the pressure of the gas within the circulating system become gradually higher because the circuit is of the closed type. In addition, the coke charged from the charging port generates the gas, and since this generated gas stays in a space between the charging port (4) and the heaped coke, this also contributes to the increased pressure within the system.

Figure 3:
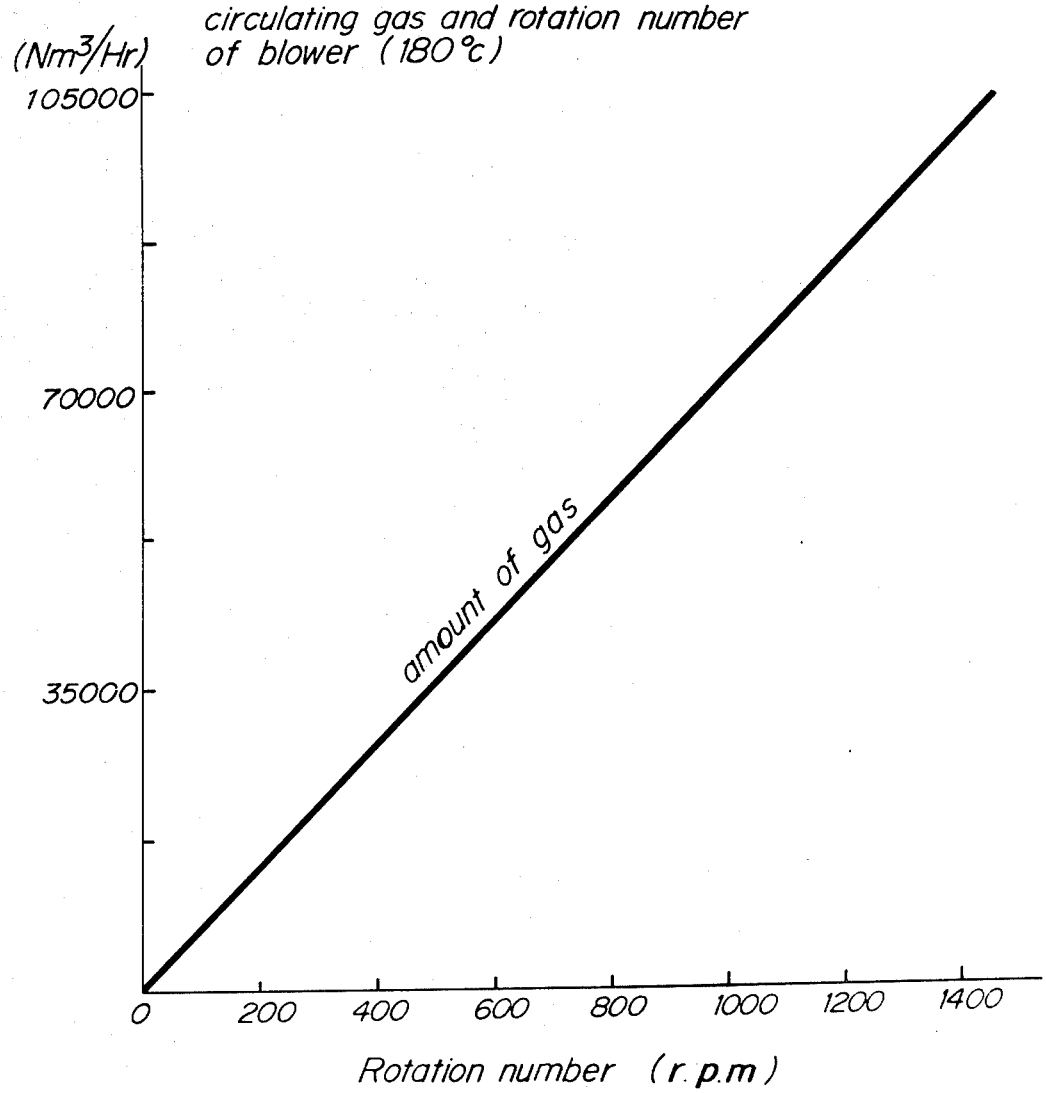
FIG. 3 shows the relationship between the amount of the quenching gas and the speed of rotation of a fan circulating gas in the cooling chamber.

The amount of coke which is charged into cooling chamber 2 is not always constant. In other words, the rate of charge (tons of coke charged per hour) is variable. If this rate is increased more heat per unit time is introduced into the system, and if the rate is decreased less heat per unit time is introduced. Accordingly, it is necessary to vary the rate ($Nm^3/hr$) at which cooling gas is circulated through cooling chamber 2. This is accomplished by increasing or decreasing the speed (revolutions per minute-RPM) at which fan or blower 3 is rotated. As shown by FIG. 3, increasing said RPM increases the rate of gas flow and decreasing said RPM decreases the rate of such flow. RPM control can be accomplished by conventional means (e.g., weighing the hot coke before charging and adjusting the RPM of blower 3, which can be a variable speed blower, in response thereto).

As mentioned above, the divering point is fixed at one point or pressure (0±5 mm Aq), but during the operation the air and $N_2$ gas are supplied, and the gas is generated from the charged coke so that the pressure of the gas in the system is varied. In the invention, a lower bleeder (11) is arranged as shown in the duct (10*c*) communicating the fan (3) and the gas leading portion (9), and further a top bleeder (12) is also arranged at a lower portion of the charging port (4). These bleeders are respectively furnished with gas relief valves (15)(16) having opening angle adjusting means (13)(14); A pressure detector (17) is provided at the diverging point, that is, near slant flue (8) for communicating with and controlling opening angle adjusting means (13). Another pressure detector (18) is provided just under the charging port (4) for communicating with and controlling opening angle adjusting means (14). The pressure detectors (17)(18) detect pressure in the flue (8) and around the charging port (4) respectively, and when the pressure exceeds 0±5 mmAq, the adjusting means (13) or (14) is actuated to releave the gas.

In this way, the air or $N_2$ gas are introduced into the circulating system to maintain the gas balance constant, and the increasing pressure is detected by means of the dector (17) and is controlled by the relief valve (15) to be 0±5 mmAq. When the pressure in the space under the charging port (4) is increased by the gas caused from the charged red hot coke, the gas is automatically releaved by the relief valve (16) to be 0±5 mmAq.

The diverging point is fixed at the slant flue (8) during the dry quenching operation, and the pressure at the diverging point and the pressure above this point are controlled by adjusting the opening angles of the relief valves to stabilize the pressure within the circuit. Therefore, the pressure of the slant flue (8) when charging the red hot coke may be made constant ±0 mmAq, thereby preventing emission from the charging port (4) when opening the cover (20), or combination due to the absorption of the air. Thus, the facilities are prevented from damages.

Examples according to the invention are as follows.

Figure 2:
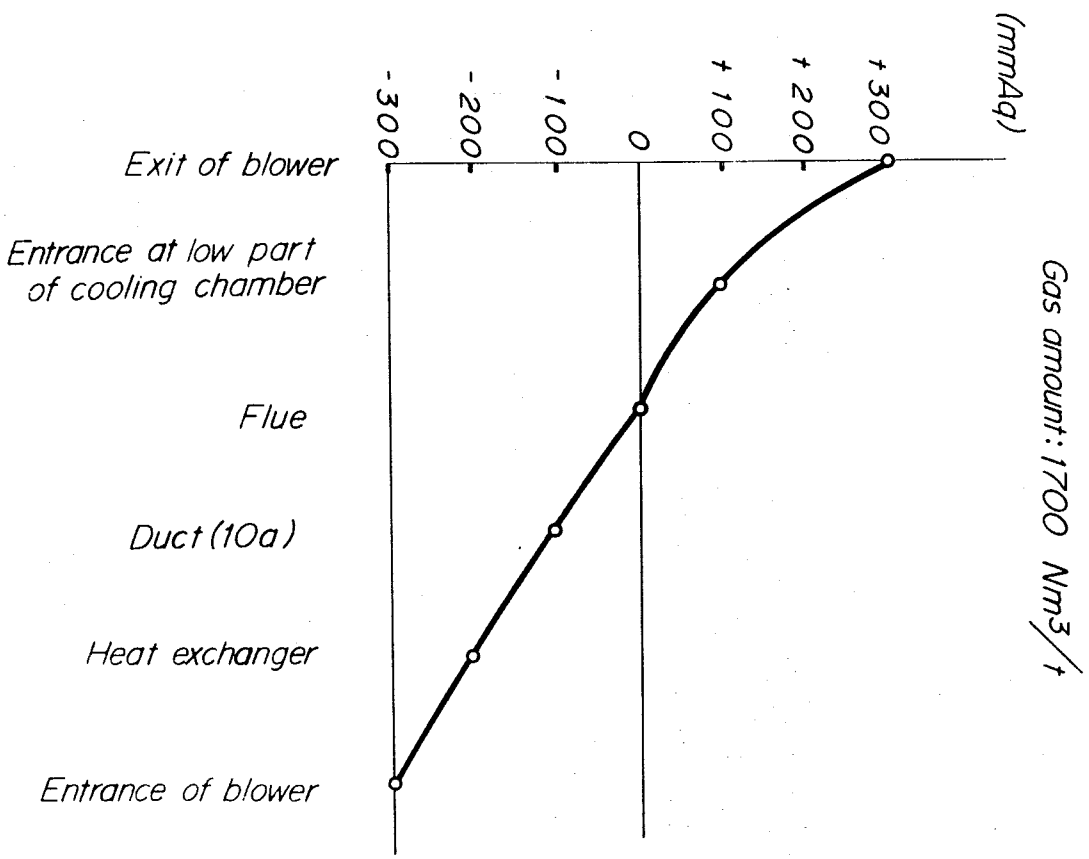
FIG. 2 shows the distribution of pressure prevailing in respective parts of the gas circulating circuit.

FIG. 2 is one example showing the distribution of the pressure prevailing in the respective parts of the gas circulating system when the amount of the gas flowing is 1700 $Nm^3/t$, from which it is seen that the pressure within the slant flue is always kept zero, and the pressure after this region is so low that the heat exchanging is satisfied in the exchanger, and the pressure passing through the gas leading portion (9) is enough to cause the gas to remove heat from the coke.

Figure 4:
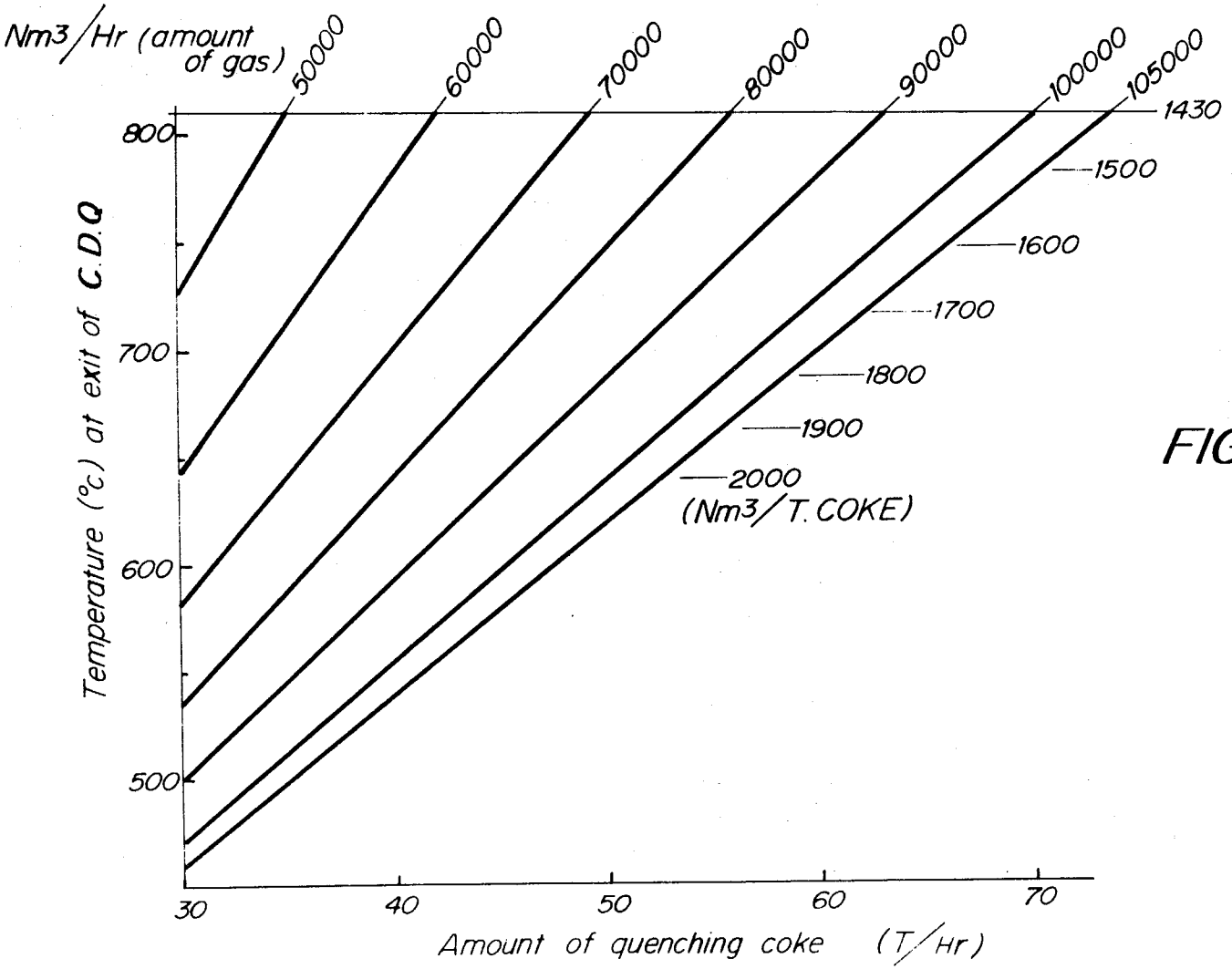
FIG. 4 shows the relationship between the temperatures at an exit of the coke dry quenching station and the amount of quenched coke.

FIG. 3 is one example showing the relation between the amount of circulating gas and the speed of rotation (r.p.m.) of the blower (3) when the temperature of the gas from the exit of the heat exchanger (2) to the entrance of the cooling chamber is 180° C., from which it is seen that, for example, the gas amount of 70,000 $Nm^3/h$ requires 1000 r.p.m., or 500 r.p.m. is necessary for 35,000 $Nm^3/h$. Thus, the zero point of the pressure within the slant flue shown in FIG. 2 is automatically maintained. FIG. 4 shows the relationship between the temperatures of gas passing the exit of C.D.Q. (Coke Dry Quenching) and the amount of quenching coke. The temperatures are determined by the conditions of the heat exchanger (2), and it is seen that, for example, when the temperature at the exit of C.D.Q. is about 780° C. and for quenching the coke of 60 t/h, the gas of 90,000 $Nm^3/h$ is necessary, and this volume corresponds to 1500 $Nm^3/t$ coke. When the temperature is about 690° C. and for quenching the coke of 56t/h, the gas of 100,000 $Nm^3/h$ is necessary which corresponds to 1800 $Nm^3/t$. coke. As can be seen from the above examples the speed of rotation of the fan is varied in order to vary the flow rate of gas through the circulating system. The flow rate is varied in accordance with the quantity and temperature of the coke which is to be quenched. The pressures in the circulating system are controlled such that the diverging point remains fixed at the flue when there are changes in the quantity and temperature of coke, or flow rate of the gas. The term pressure, as used herein, means gage pressure.

We claim:

1. A method of controlling pressure of gas circulating in a coke dry quenching apparatus including a quenching station having an upper portion, a lower portion, a coke charging port at the top thereof, a coke discharging port at the bottom thereof, a flue therein positioned in the upper portion thereof, and a blower and duct means for circulating quenching gas through said quenching station in a direction such that the gas flows from the lower portion of said quenching station to the upper portion thereof, said method comprising:

(a) controlling the speed of rotation of said blower means to control the flow rate of gas through said quenching station in response to the amount and temperature of the coke charges;

(b) controlling the pressure of the gas flowing through said quenching station such that the diverging point of the gas is fixed at said flue by measuring the pressure of the gas at said flue and adjusting the pressure at said flue such that the gage pressure is 0±5 mm Aq by venting gas from said quenching apparatus.

2. A method of controlling pressure gas circulating in a coke dry quenching apparatus including a quenching station having an upper portion, a lower portion, a coke charging port at the top thereof, a coke discharging port at the bottom thereof, a flue therein positioned in the upper portion thereof, and a blower and duct means for circulating quenching gas through said quenching station in a direction such that the gas flows from the lower portion of said quenching station to the upper portion thereof, said method comprising:

(a) controlling the speed of rotation of said blower means to control the flow rate of gas through said quenching station in response to the amount of coke charged with said speed being increased when the amount of coke charged is increased and decreased when the amount of coke charged is decreased;

(b) controlling the pressure of the gas flowing through said quenching station such that the diverging point of the gas is fixed at said flue by measuring the pressure of the gas at said flue and adjusting the pressure at said flue such that the gage pressure is 0±5 mm Aq by venting gas from said quenching apparatus.

* * * * *